US007671731B2

(12) United States Patent
Loges

(10) Patent No.: US 7,671,731 B2
(45) Date of Patent: Mar. 2, 2010

(54) WARNING SYSTEM FOR A BUILDING WITH EVALUATION UNITS

(75) Inventor: Heinz-Juergen Loges, Aschaffenburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/908,561

(22) PCT Filed: Nov. 17, 2006

(86) PCT No.: PCT/EP2006/068620

§ 371 (c)(1),
(2), (4) Date: Sep. 13, 2007

(87) PCT Pub. No.: WO2007/073991

PCT Pub. Date: Jul. 5, 2007

(65) Prior Publication Data

US 2008/0246600 A1 Oct. 9, 2008

(30) Foreign Application Priority Data

Dec. 23, 2005 (DE) ..... 10 2005 062 129

(51) Int. Cl.
*G08B 1/00* (2006.01)
*G08B 9/00* (2006.01)
*G08B 23/00* (2006.01)

(52) U.S. Cl. ..... 340/531; 340/534; 340/506; 340/540; 340/286.02

(58) Field of Classification Search ..... None
See application file for complete search history.

(56) References Cited

U.S. PATENT DOCUMENTS

| | | | | |
|---|---|---|---|---|
| 5,396,180 | A * | 3/1995 | Hampton et al. | 324/551 |
| 2002/0180598 | A1 | 12/2002 | Pfefferseder et al. | |
| 2003/0058590 | A1 | 3/2003 | Gershen et al. | |
| 2005/0134450 | A1 * | 6/2005 | Kovach | 340/506 |

FOREIGN PATENT DOCUMENTS

| | | |
|---|---|---|
| DE | 38 26 895 | 3/1990 |
| DE | 101 05 189 | 8/2002 |
| WO | 97/26635 | 7/1997 |

* cited by examiner

*Primary Examiner*—Julie Lieu
(74) *Attorney, Agent, or Firm*—Michael J. Striker

(57) ABSTRACT

A warning system for buildings has evaluation units embodied as freely-programmable control units, and the evaluation units have at least one first interface with a building security bus, the evaluation units also have second interfaces for furnishing a high data transmission rate, and a data connection between a building management system and a first evaluation units is made by a series connection to at least one further evaluation unit via the second interfaces.

8 Claims, 1 Drawing Sheet

WARNING SYSTEM FOR A BUILDING WITH EVALUATION UNITS

CROSS-REFERENCE TO RELATED APPLICATION

The invention described and claimed hereinbelow is also described in German Patent Application DE 10 2005 062 129.5 filed on Dec. 23, 2005. This German Patent Application, whose subject matter is incorporated here by reference, provides the basis for a claim of priority of invention under 35 U.S.C. 119(a)-(d).

BACKGROUND OF INVENTION

The invention relates to a warning system for buildings, with evaluation units embodied as freely-programmable control units.

From Published German Patent Disclosure DE 101 05 189 A1, a universally usable monitoring device for retrofitted installation in a warning system is known. This monitoring device has an interface with a building security bus. It is also known from DE 101 05 189 A1 that the monitoring device furnishes a serial interface that makes the connection of autonomous devices possible.

SUMMARY OF THE INVENTION

Accordingly, it is an object of the present invention to provide a warning system which eliminated disadvantages of the prior art.

In keeping with these objects one feature of the present invention resides, briefly stated in a warning system for buildings, having evaluation units embodied as freely-programmable control units (FPS), and the evaluation units have at least one first interface with a building security bus, characterized in that the evaluation units have second interfaces for furnishing a high data transmission rate; and that a data connection between a building management system and a first evaluation unit is made by a series connection to at least one further evaluation unit via the second interfaces.

The warning system for buildings, described hereinafter, in accordance with the present invention has the advantage that the warning system can be used flexibly and in a way that is adapted to particular local conditions of use. It is especially advantageous that the safety-specific parameters in the fire, theft and emergency call field, furnished by respective alarms, can be assessed in a targeted way and quickly in the area of the particular location by the evaluation units. At the same time, the warning system described has the advantage that because of the evaluation units connected in series (daisy chain), great distances, in particular of several kilometers, can be spanned. This especially advantageously contributes to the fact that the described warning system can be used not only for monitoring in the field of communities, such as hospitals and nursing homes, but also in public areas, for instance for controlling emergency exit doors, and private areas for residential security. It is also possible to use the warning system in a combination of these areas. The warning system moreover has the advantage that because the evaluation unit is embodied as a freely-programmable control unit (FPS) and because local security buses are connected, small autonomous, self-contained security areas are connected to large-scale systems via the connection to a building management system. It is especially advantageous that the evaluation units are connected with the building management system into a ring, since this contributes to increasing the fail-safety of the warning system.

Further advantages will become apparent from the ensuing description of exemplary embodiments with reference to the drawings and the dependent claims.

DESCRIPTION OF THE PREFERRED EMBODIMENTS

Figure 1:
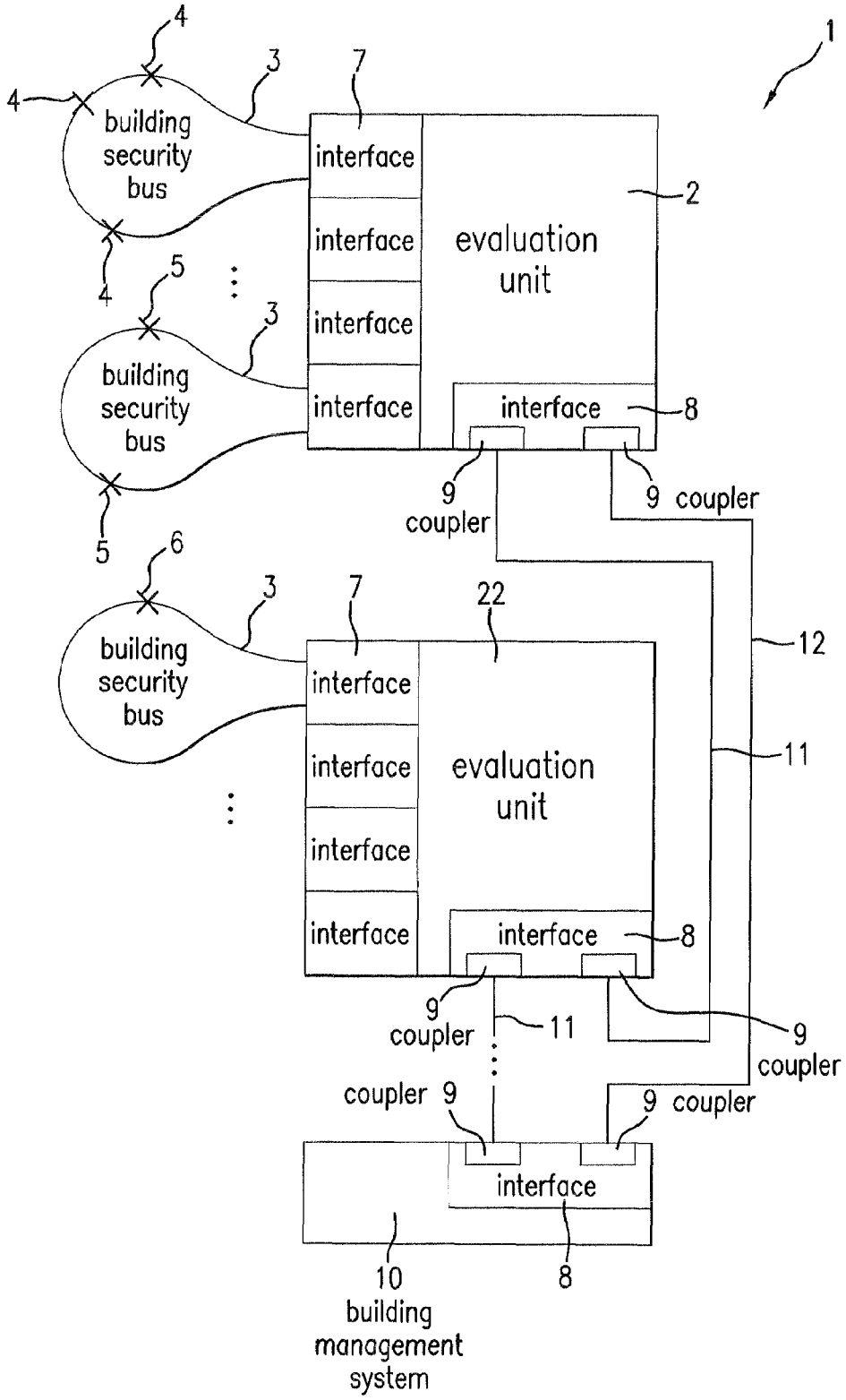
FIG. 1 of the drawings is a view showing a warning system for a building in accordance with the present invention.

A warning system for buildings with evaluation units embodied as freely-programmable control units and with a building management system will be described below. By means of serial connection, the evaluation units are connected to the building management system via a high-speed data connection.

FIG. 1 shows a warning system 1 for buildings, including a plurality of evaluation units 2, 22 embodied as freely-programmable control units (FPS), and a building management system 10. The evaluation units 2, 22 are distinguished by the fact that they have a large number of inputs and memory-programmable outputs. Furthermore, the evaluation units 2, 22 include a microprocessor as well as both nonvolatile and volatile memory units. The nonvolatile memory units are read-only memories (ROM) or rewritable ROMs, such as an EPROM. The evaluation units 2, 22 are embodied such that a processing program, which links the input signals of the inputs to output signals of the outputs, is freely programmable and is stored in memory in the nonvolatile memory units. The volatile memory units are random access memories (RAM), which are used for buffer storage of data of the processing program. The evaluation units 2, 22 moreover have four interfaces 7 of a first type, which are designed for connection of a building security bus 3. The building security bus is preferably the known LSN (Local Security Network) security bus. The building security buses 3 are connected as a ring to the interface 7 of the first type. The building security buses 3 are furthermore designed such that fire alarms 4, combined with other types of alarms such theft alarms 5 and/or emergency call alarms 6, can be operated on the building security bus 3. Furthermore, the evaluation units 2, 22 include an interface 8 of a second type, which is designed for furnishing a high data transmission rate. The data transmission rate is preferably 9600 bit/s or more. When eight evaluation units are used, the data transfer time is 600 ms. The interfaces 8 of the second type each include two optoelectronic couplers 9, which are designed such that the evaluation units 2, 22 galvanically decoupled from respective data lines 11, 12, connected to their interface 8, for making the data connection. In the preferred exemplary embodiment, a first evaluation unit 2 is connected via its interface 8 of the second type and an optoelectronic coupler 9 is connected via a data line 11 to a substantially identically constructed, second evaluation unit 22, by means of its interface 8 of the second type and its optoelectronic coupler 9, by series connection. Both evaluation units 2, 22 have the aforementioned interfaces 7 of the first type, which are designed such that the four building security buses have a total length of 1000 m; a total of up to 127 alarms of different types, in particular fire alarms 4, theft alarms 5 and/or emergency call alarms 6, are connected. The second evaluation unit 22 is connected, via the interface 8 of the second type and its optoelectronic coupler 9 and via a data line, to further evaluation units, not shown but essentially identical, and finally to a building management system 10. The building management system 10 likewise includes an interface 8 of the second type, with two optoelectronic couplers 9 for connection to two data lines 11, 12. In the preferred exemplary embodiment, the building management system 10 is connected, via the second optoelectronic coupler 9 and a second data line 12, to the optoelectronic coupler 9 of the interface 8 of the first evaluation unit 2 in such a way that the connected evaluation units 2, 22 and the building management system 10 form a ring. The embodiment as a ring is not absolutely necessary, but it is advantageous for the sake of fail-safe reliability of the warning system 1. The building management system 10 is designed such that it processes not only the data from the evaluation units 2, 22 but also data from further equipment, in particular from access control systems and/or heating and ventilation systems and/or video systems and/or acoustical systems. The building management system 10 is a computer-supported user-control and information system, which in the event of an alarm assures safe user control and initiation of appropriate provisions. It is embodied as either a single- or multiple-site system. In the preferred exemplary embodiment, the length of the data lines 11, 12 between two evaluation units 2, 22, or between one evaluation unit 2, 22 and the building management system 10, amounts to between 500 and 1000 meters. The evaluation units 2, 22 are constructed substantially identically with regard to the interfaces 7, 8 and the further inputs and outputs. Only the processing programs are adapted to the particular given conditions of the alarms connected and of the localities. The evaluation units 2, 22 are distinguished by the fact that the evaluation units 2, 22 are embodied such that they process and assess the safety-specific parameters of the alarms connected, by means of the processing programs adapted to the particular given situation. The evaluation units 2, 22 evaluate the signals transmitted from the alarms via the building security bus 3, and as a function of the signals they generate digitally encoded alarm reports. These digitally encoded alarm reports are furnished to the second interfaces 8 for transmission to the building management system 10. The evaluation units 2, 22 are designed such that each evaluation unit 2, 22 furnishes the alarm reports, received from a further evaluation unit 2, 22, to the second interfaces 8 for forwarding to the building management system 10.

The invention claimed is:

1. A warning system (1) for buildings, having evaluation units (2, 22) embodied as freely-programmable control units (FPS), and the evaluation units (2, 22) have at least one first interface (7) with a building security bus (3), characterized in that the evaluation units (2, 22) have second interfaces (8) for furnishing a high data transmission rate; and that a data connection between a building management system (10) and a first evaluation unit (2) is made by a series connection to at least one further evaluation unit (22) via the second interfaces (8).

2. The warning system (1) as defined by claim 1, characterized in that the second interfaces (8) include an optoelectronic coupler (9) designed such that the evaluation units (2, 22) are galvanically decoupled from a data line (11, 12), connected to their second interface (8), in order to make the data connection.

3. The warning system (1) as defined by claim 2, characterized in that the data line (11, 12) between two evaluation units (2, 22) and/or between the evaluation units (2, 22) and the building management system (10) has a length of between 500 and 1000 meters.

4. The warning system (1) as defined by claim 1, characterized in that the evaluation units (2, 22) and the building management system (10) are connected into a ring.

5. The warning system (1) as defined by claim 1, characterized in that alarms, in particular fire alarms (4) and/or theft alarms (5) and/or emergency call alarms (6), are connected to the building security bus (3).

6. The warning system (1) as defined by claim 5, characterized in that the evaluation units (2, 22) evaluate the signals transmitted from the alarms via the building security bus (3), as a function of the signals generate digitally encoded alarm warnings, and furnish the alarm warnings at the second interface (8) for transmission to the building management system (10).

7. The warning system (1) as defined by claim 6, characterized in that the evaluation units (2, 22) are designed such that the evaluation units (2, 22) furnish the alarm reports, received from said at least one further evaluation unit (2, 22), to the second interfaces (8) for forwarding to the building management system (10).

8. The warning system (1) as defined by claim 1, characterized in that the first evaluation unit (2) and the further evaluation units (22) are constructed essentially identically.

* * * * *